US007080536B2

(12) United States Patent
Kapp

(10) Patent No.: US 7,080,536 B2
(45) Date of Patent: Jul. 25, 2006

(54) DEVICE FOR MANUFACTURING FORMED PARTS BY INTERNAL HIGH PRESSURE DEFORMATION

(75) Inventor: Dieter Kapp, Wilnsdorf (DE)

(73) Assignee: Theodor Gräbener GmbH & Co. KG, Netphen-Werthenbach (DE)

( * ) Notice: Subject to any disclaimer, the term of this patent is extended or adjusted under 35 U.S.C. 154(b) by 0 days.

(21) Appl. No.: 10/902,403

(22) Filed: Jul. 28, 2004

(65) Prior Publication Data

US 2005/0022576 A1 Feb. 3, 2005

(30) Foreign Application Priority Data

Jul. 30, 2003 (DE) ..... 103 34 660

(51) Int. Cl.
*B21D 13/02* (2006.01)
*B21D 22/12* (2006.01)

(52) U.S. Cl. ..... 72/63; 72/60; 72/184; 100/269.17; 425/370

(58) Field of Classification Search ..... 72/60, 72/63, 184, 190; 92/102; 425/370, 389; 100/269.17, 214
See application file for complete search history.

(56) References Cited

U.S. PATENT DOCUMENTS

| | | | | | |
|---|---|---|---|---|---|
| 2,962,994 | A | * | 12/1960 | Wheelon | 72/63 |
| 3,120,205 | A | * | 2/1964 | Pfeiffer et al. | 72/63 |
| 3,545,241 | A | * | 12/1970 | Grankowski et al. | 72/63 |
| 3,938,361 | A | * | 2/1976 | Claesson et al. | 72/63 |
| 3,943,741 | A | | 3/1976 | Sunderland | |
| 3,971,243 | A | * | 7/1976 | Jones | 72/63 |
| 4,250,735 | A | * | 2/1981 | Spedding | 72/455 |

* cited by examiner

*Primary Examiner*—David B. Jones
(74) *Attorney, Agent, or Firm*—Friedrich Kueffner

(57) ABSTRACT

A device for manufacturing formed parts by internal high pressure deformation. The device includes a housing composed of two tubular members which are placed one into the other and are connected by shrinkage, wherein the tool support unit is mounted in the concentric bore of the inner tubular member.

3 Claims, 3 Drawing Sheets

DEVICE FOR MANUFACTURING FORMED PARTS BY INTERNAL HIGH PRESSURE DEFORMATION

BACKGROUND OF THE INVENTION

1. Field of the Invention

The present invention relates to a device for manufacturing formed parts by internal high pressure deformation.

2. Description of the Related Art

Devices of the above-described type have long been known in the art as presses. Because of their construction and the required dimensions due to the forces occurring during the deformation process, the space required by these presses is very large.

SUMMARY OF THE INVENTION

Therefore, it is the primary object of the present invention to provide a device of the above-described type which is of very compact construction and is still capable of absorbing high forces within a small space without causing bending of the device or the tool, while achieving a very high accuracy of the formed part.

In accordance with the present invention, the device includes a housing composed of two tubular members which are placed one into the other and are connected by shrinkage, wherein the tool support unit is mounted in the concentric bore of the inner tubular member.

The device according to the present invention has the primary advantage that the device is of relatively compact construction and carries out only a minimum of functions, so that the costs for such a device are substantially reduced.

Another advantage of the device of the present invention is the fact that the stresses occurring during the deformation process are distributed over the two tubular members which are placed one into the other, so that significantly higher forces can act on the device without causing bending of the device or the tool and, thus, of the manufactured formed part.

Short-stroke cylinders arranged between the tool support and the tool halves ensure that the tool is held closed in an optimum manner during the deformation process.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
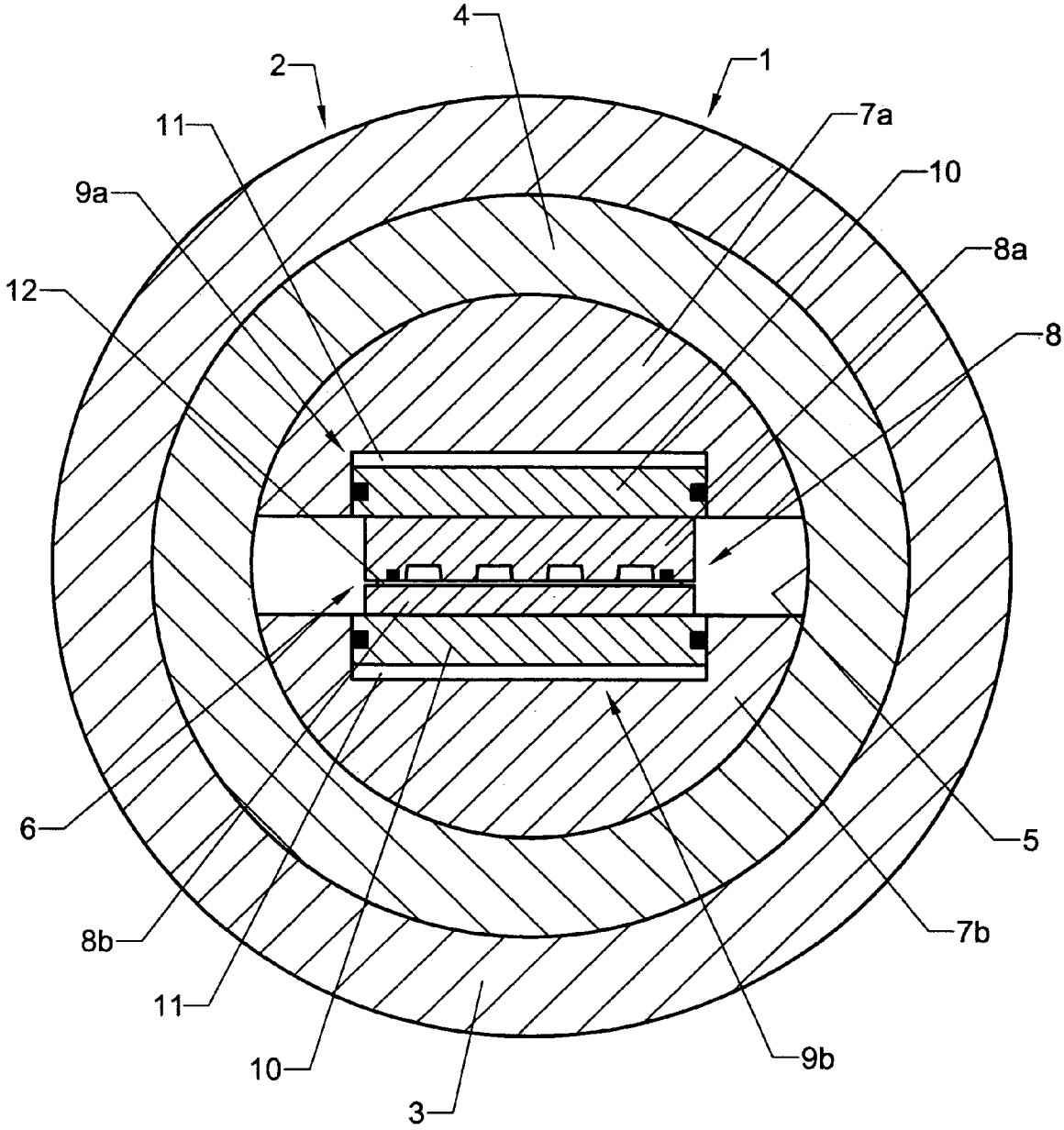
FIG. 1 is a schematic cross-sectional view of a first embodiment of the device according to the invention.
Figure 2:
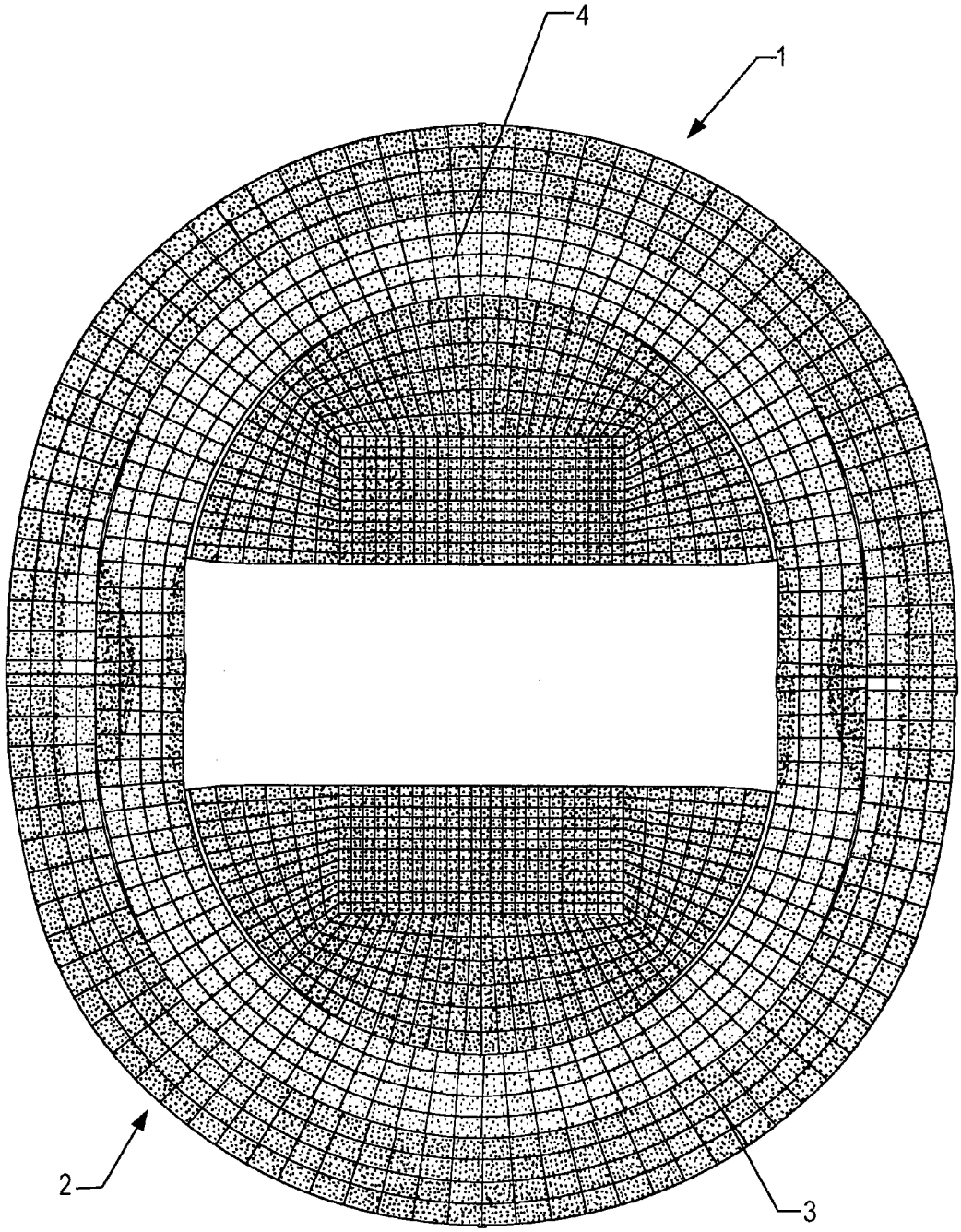
FIG. 2 is a cross-sectional view of the device with pressure application without tool and short-stroke cylinder.

The device 1 illustrated in the drawing for manufacturing formed parts by internal high pressure deformation is composed essentially of a housing 2 which includes two tubular members 3, 4 which are placed one into the other and which are connected to each other by shrinkage. A tool support unit 6 is placed in the concentric bore 5 of the inner tubular member 4, wherein the tool support unit 6 can be moved out of the housing 2 for a tool exchange.

The tool support unit 6, in turn, is composed essentially of two approximately half shell-shaped tool supports 7*a*, 7*b*, wherein a tool 8 is arranged between the tool supports 7*a*, 7*b*, and wherein between each tool support 7*a*, 7*b* and the respective tool half 8*a*, 8*b* is arranged at least one short-stroke cylinder 9*a*, 9*b* to which a pressure medium, for example oil, can be admitted. As seen in FIG. 1, the short-stroke cylinders 9*a*, 9*b* each consist of a piston 10 which is embedded and sealed in a bore 11 in the tool support 7*a*, 7*b*.

During the deformation process, the short-stroke cylinders 9*a*, 9*b* hold the two tool halves 8*a*, 8*b* in their closing position, while a medium, for example, water or oil, acts on the tool 8 or the workpiece 12 between the two workpiece halves 8*a*, 8*b* during the deformation process.

By placing the two tubular members 3, 4 one into the other to form a housing 2 and by a targeted application of a counter pretension by shrinking the two tubular members 3, 4 onto each other, a significant reduction of the maximum stresses is achieved as compared to the use of a single tubular member as housing or of a rectangular frame as housing.

Figure 3:
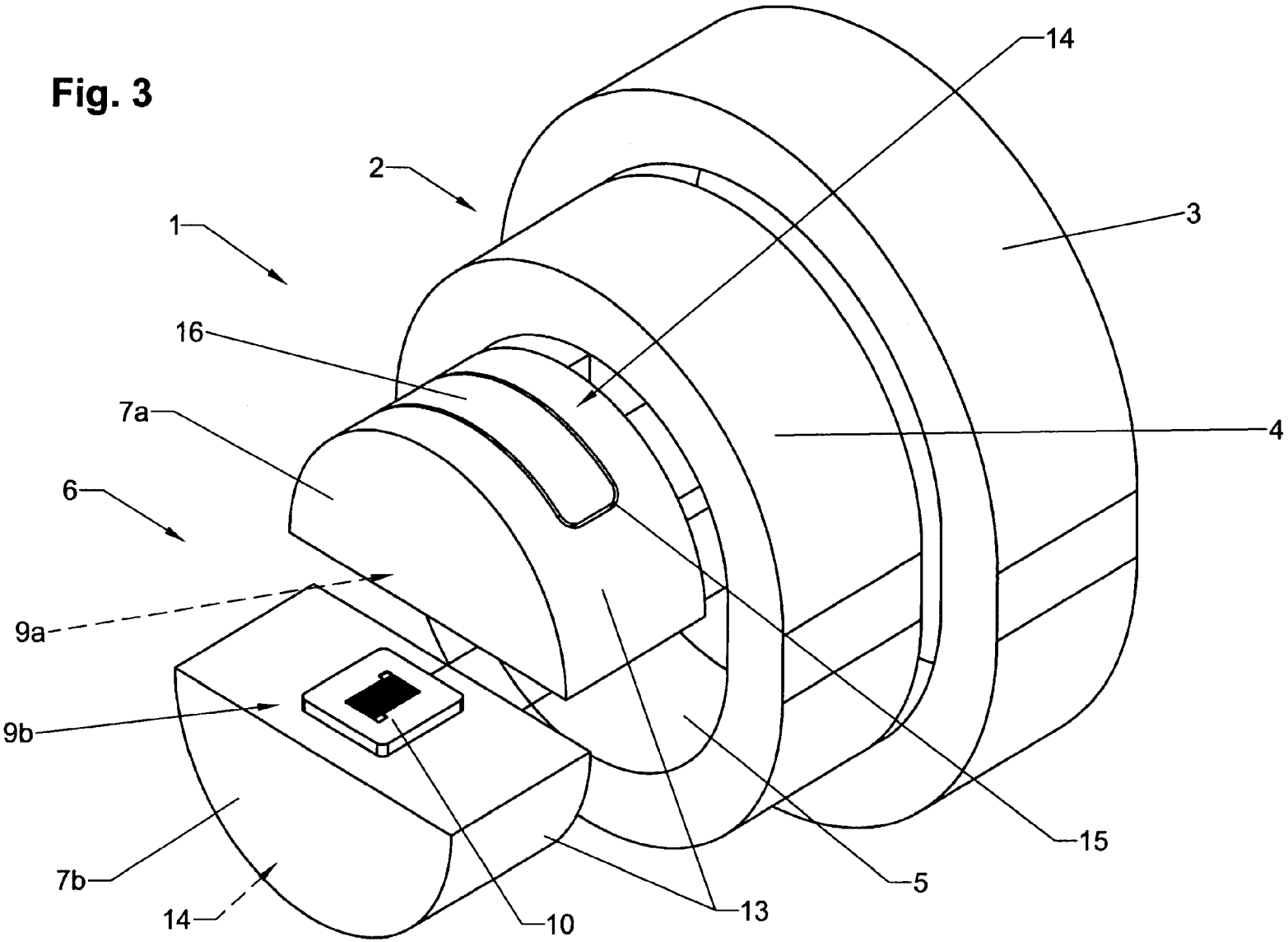
FIG. 3 is an exploded view of a second embodiment of the device according to the invention.

In the case of extremely high pressures and possibly for compensating for deformations of the tubular members 3, 4 in the area of the half shell-shaped tool carriers 7*a*, 7*b*, a pressure cushion 14 on which a pressure medium can act may be provided at the outer circumference 13 of the tool support 7*a* 7*b* above or below the short-stroke cylinder 9*a*, 9*b*. Each pressure cushion 14 is formed by an active surface 16 on the circumference 13 of the half shell-shaped tool support 7*a*, 7*b*, wherein the active surface 16 is surrounded by a sealing member placed in a groove 15, as seen in FIG. 3.

While specific embodiments of the invention have been shown and described in detail to illustrate the inventive principles, it will be understood that the invention may be embodied otherwise without departing from such principles.

I claim:

1. A device for manufacturing formed parts by internal high pressure deformation, the device comprising a housing comprised of two tubular members which are placed one into the other and are connected to one another by shrinkage, wherein a tool support unit is mounted in a concentric bore of the inner tubular member, the tool support unit being comprised of two essentially half shell-shaped tool supports, wherein a tool is fastened to the tool supports, wherein at least one short-stroke cylinder activated by a pressure medium is mounted between each tool support and a tool half, and wherein the short-stroke cylinder is configured to hold the two tool halves in a closed position thereof during the deformation process.

2. The device according to claim 1, wherein a pressure cushion activated by a pressure medium is arranged on an outer circumference of the half shell-shaped tool support above or below the at least one short-stroke cylinder.

3. The device according to claim 2, wherein each pressure cushion is comprised of an active surface on the circumference of the half shell-shaped tool support, and wherein each active surface is enclosed by a sealing member mounted in a groove in the outer circumference.

* * * * *